United States Patent [19]

Carey et al.

[11] Patent Number: 5,075,930

[45] Date of Patent: Dec. 31, 1991

[54] CARDING ENGINE

[75] Inventors: Peter Carey; Michael Carstairs, both of Huddersfield, England

[73] Assignee: Crosrol Limited, Holmfield, England

[21] Appl. No.: 457,712

[22] PCT Filed: Mar. 18, 1989

[86] PCT No.: PCT/GB89/00407

§ 371 Date: Oct. 19, 1989

§ 102(e) Date: Oct. 19, 1989

[87] PCT Pub. No.: WO89/10440

PCT Pub. Date: Nov. 2, 1989

[30] Foreign Application Priority Data

Apr. 20, 1989 [GB] United Kingdom ..... 8809353

[51] Int. Cl.[5] ..... D01G 15/24; D01G 15/80

[52] U.S. Cl. ..... 19/104; 19/102; 19/107

[58] Field of Search ..... 19/102, 104, 108, 110, 19/113, 109

[56] References Cited

U.S. PATENT DOCUMENTS 3,036,343 5/1962 Strang ..... 19/104

*Primary Examiner*—Werner H. Schroeder
*Assistant Examiner*—John J. Calvert
*Attorney, Agent, or Firm*—Darby & Darby

[57] ABSTRACT

A card is provided with a cover assembly adapted to provide enhanced cleaning efficiency. The cover is 4 covers in one with each part being set at a prescribed distance from the carding cylinder to induce increased cleaning. Air drawn through a gap at the first cover disturbs and intermingles with the fibers and loosen dirt. The fourth cover exerts centripetal action to strip away waste from the fiber.

10 Claims, 3 Drawing Sheets

CARDING ENGINE

TECHNICAL FIELD

This invention relates to carding engines.

BACKGROUND

Carding engines comprise a feed roller cooperating with a feed pate to provide a supply of material. A toothed takerin takes the material from the feed plate and transfers it to a toothed main carding cylinder. A series of flats, which may be movable or stationary, cooperate with an arc of the carding cylinder, the flats having carding elements confronting the teeth on the cading cylinder so that a carding action is performed between the flats and the cylinder. After such carding, the resulting fibrous web is taken from the main carding cylinder by a toothed doffer, and is then removed from the doffer by a stripper, from which the web is taken to be fed from the carding engine.

The action of the carding engine is to remove waste material from the feed stock and also to align the usable fibres of the feed stock and also to align the usable main carding action is performed between the flats and the main carding cylinder, carding and cleaning action also occurs on the takerin and in other areas of the main carding cylinder, and particular elements may be associated with either of theses toothed members to enhance the cleaning or straightening effect.

The rotary members of the carding engine rotate at high speed and substantial air currents are generated during operation. Control of these air currents is important to the efficiency of the carding operation, particularly the effective use of air in loosening and removing waste from the fibre without also removing significant quantities of usable fibre, and in extracting the waste from the machine. Various forms if cover for the toothed members are known that can assist in controlling the air flow.

For example, EP-A-0019455 discloses covering that arc of the main carding cylinder which extends from the flats to the doffer with a cover that includes a restriction affecting air pressure in the region where the flats leave the cylinder. The amount of material removed by the flats and taken therefrom as flat strips can be subjected to a degree of control in this way.

GB-B-1483291 discloses a carding engine having a cover over that arc of the main cylinder that extends from the carding means to the doffer, the cover including a plate portion that has a leading edge positioned closely spaced from the trailing edge of the carding means to define a passageway. The combination of centripetal force and induced air flow through the passageway allows trash particles to be thrown from the cylinder and through the passageway, an effect enhanced by a sharpened leading edge of the plate portion.

The present invention seeks to control air flow and trash removal in a novel manner, with the intention of improving the cleaning efficiency of a carding engine, at least when running with some feedstocks. Even small improvements in card cleaning efficiency are of significance in forming silver of better quality.

DISCLOSURE OF THE INVENTION

According to the invention a carding engine comprises a feed roller, a toothed takerin, a toothed main carding cylinder and a toothed doffer, in which part of the circumference of at least one of the aforesaid toothed members is covered across substantially its full width by a cover assembly which, following the direction of rotation, comprises a first cover, a second cover set radially closer to the toothed member than the first cover, a third cover spaced circumferentially from the second cover by a first gap and set radially further from the toothed member than the second cover, a fourth cover spaced circumferentially from the third cover by a second gap and having a leading edge shaped to divert away from the toothed member part of the air stream flowing beneath the third cover during rotation of the toothed member.

It has been found that the effect of this cover assembly is to draw air in through the first gap to disturb and intermingle with the material carried on the toothed member beneath the third cover. The concept of inducing additional air in this region has not, so far as we known, been previously proposed. Air is released from the surface of the toothed member at the second gap and directed away from the toothed member by the leading edge of the fourth cover. Effectively, the fourth cover diverts away from the toothed member the radially outer layer of air, and due to centripetal action the waste that is freed due to the turbulent intermingling beneath the third cover, being heavier than the usable fibre, is contained chiefly in this outer air layer. Thus, an additional significant degree of waste is removed, without any appreciable loss of usable fibre. Test have shown that significant increases in cleaning efficiency can be achieved by use of the invention.

Preferably the second cover is formed by at least one flat bar having carding elements confronting the teeth of the toothed member. A flat bar forms a very efficient air barrier and induces a significant drop in air pressure at the cylinder surface as it moves past the flat bar to the first gap. A significant air intake through the first gap is thus assured.

Preferably the third cover has a smooth inner surface confronting the teeth of the toothed member in order to minimize retention of material on the inner surface of that cover.

Preferably the third cover has a smooth inner surface confronting the teeth of the toothed member in order to minimize retention of material on the inner surface of that cover.

The leading edge of the fourth cover may comprise a knife edge, but preferably it comprises a rounded or otherwise shaped nose region, in each case designed to strip away from the surface of the toothed member whatever boundary layer of air and entrained waste is required. When seen in cross-section the nose region desirably has a profile that approximates to an arc of a circle having a radius of from 0.05 to 0.6 mm, more preferably from 0.125 to 0.3 mm. A sharp edge may be found to cause fibre damage with some feedstocks, while a radius greater than 0.5 mm may significantly reduce the cleaning efficiency. The most suitable radius for a given feedstock may be determined empirically.

Although it is essential that the second cover be set radially closer to the surface of the toothed member than either the first or the third cover, the actual settings involved, the setting of the fourth cover, the lengths of the individual covers and the lengths of the gaps may all be subject to variation. For a particular type of feed stock it may be best to determine optimum setting empirically, although some preferred relationships have been established. Thus, it is preferred that the third cover is set radially closer to the toothed member in the region adjacent to the first gap than in the region adjacent to the second gap. The air stream beneath the third cover is thus a divergent stream, so facilitating the diverting of the radially outer layer of that stream by the leading edge of the fourth cover. For example, the setting adjacent to the second gap may be at least twice the setting adjacent to the first gap.

The radial distance set between the third cover and the toothed member in the region adjacent to the first gap is desirably at least three times the radial distance set between the second cover and the toothed member, in order to ensure sufficient drop in air pressure to induce an adequate supply of air through the first gap.

The cover assembly may be provided around any one of the toothed members, i.e., the takerin, main carding cylinder or doffer, although provision of the assembly on the doffer is the least preferred alternative. Perhaps the most beneficial location is around part of the circumference of the main carding cylinder, and it is particularly preferred if the cover assembly is provided on the main carding cylinder over that arc of the cylinder lying between the carding elements which cooperate with the main carding cylinder to effect the carding action, and the doffer. In this region the majority of the straightening and cleaning action will already have been performed, and remaining waste will be in a relatively looser condition than it was in earlier stages of the carding process. The additional turbulence and extraction achieved by the invention can thus have maximum effect.

In any enmbodiment of the invention it is obviously desirable if relatively clean air is drawn in through the first gap, and a guard or other shielding means may be provided over the gap to ensure that induced air is drawn in only from the sides of the carding engine and not from a relatively contaminated region thereof.

MODE FOR CARRYING OUT THE INVENTION

Figure 1:
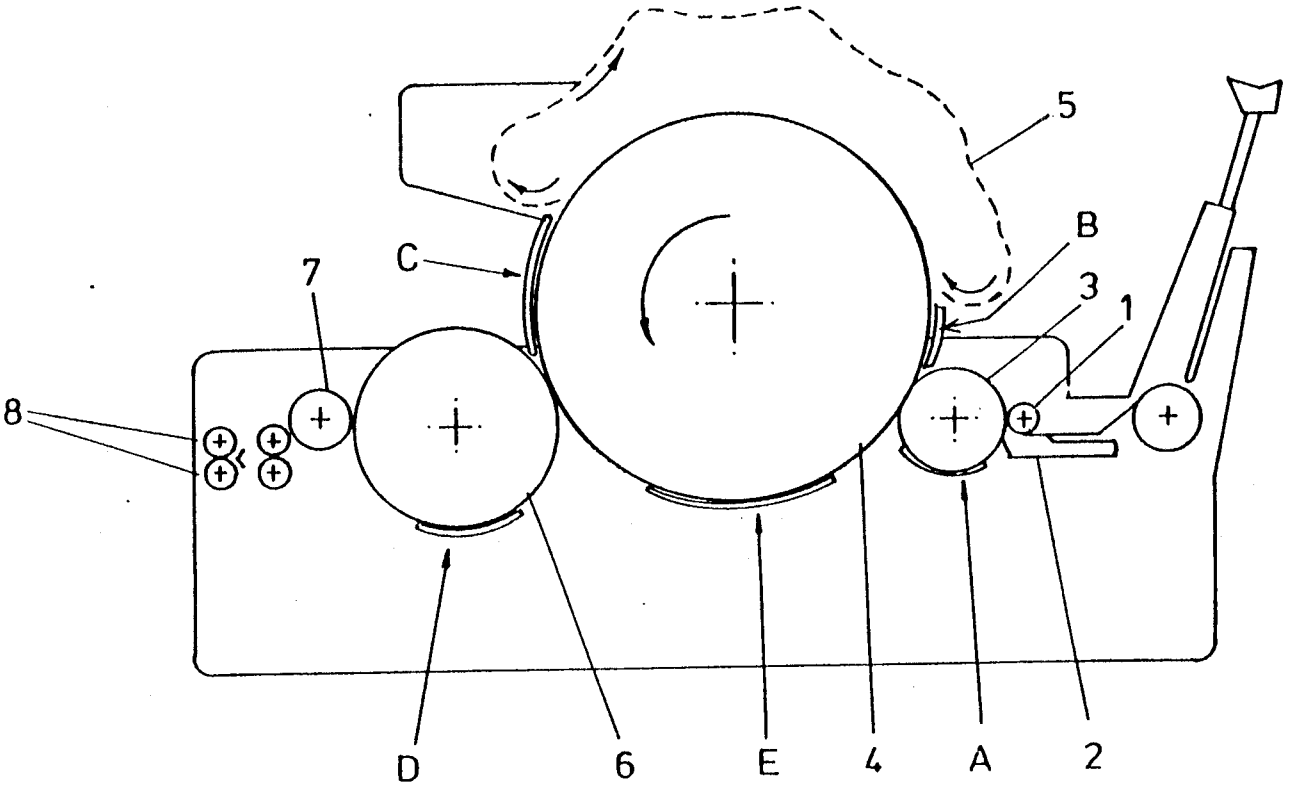
FIG. 1 is a schematic side elevation of a carding engine.

Referring first to FIG. 1 a carding engine comprises a feed roller 1 and feed plate 2, a toothed takerin 3, a toothed main carding cylinder 4 with a series of cooperating movable flats 5, a toothed doffer 6, a stripper roll 7 and web condensing and delivering means 8. In accordance with the invention a particular form of cover assembly is provided in conjunction with one of the toothed members and, for example, the cover assembly may be provided in any one of the locations indicated at A to E in FIG. 1. The preferred location is at C, i.e. on that arc of the main carding cylinder lying between the flats and the doffer, and the following description of specific embodiments of the invention will be given with reference to location C. However, it will be understood that the general teaching to be gained from the following description is applicable to a cover assembly at any other location.

Figure 2:
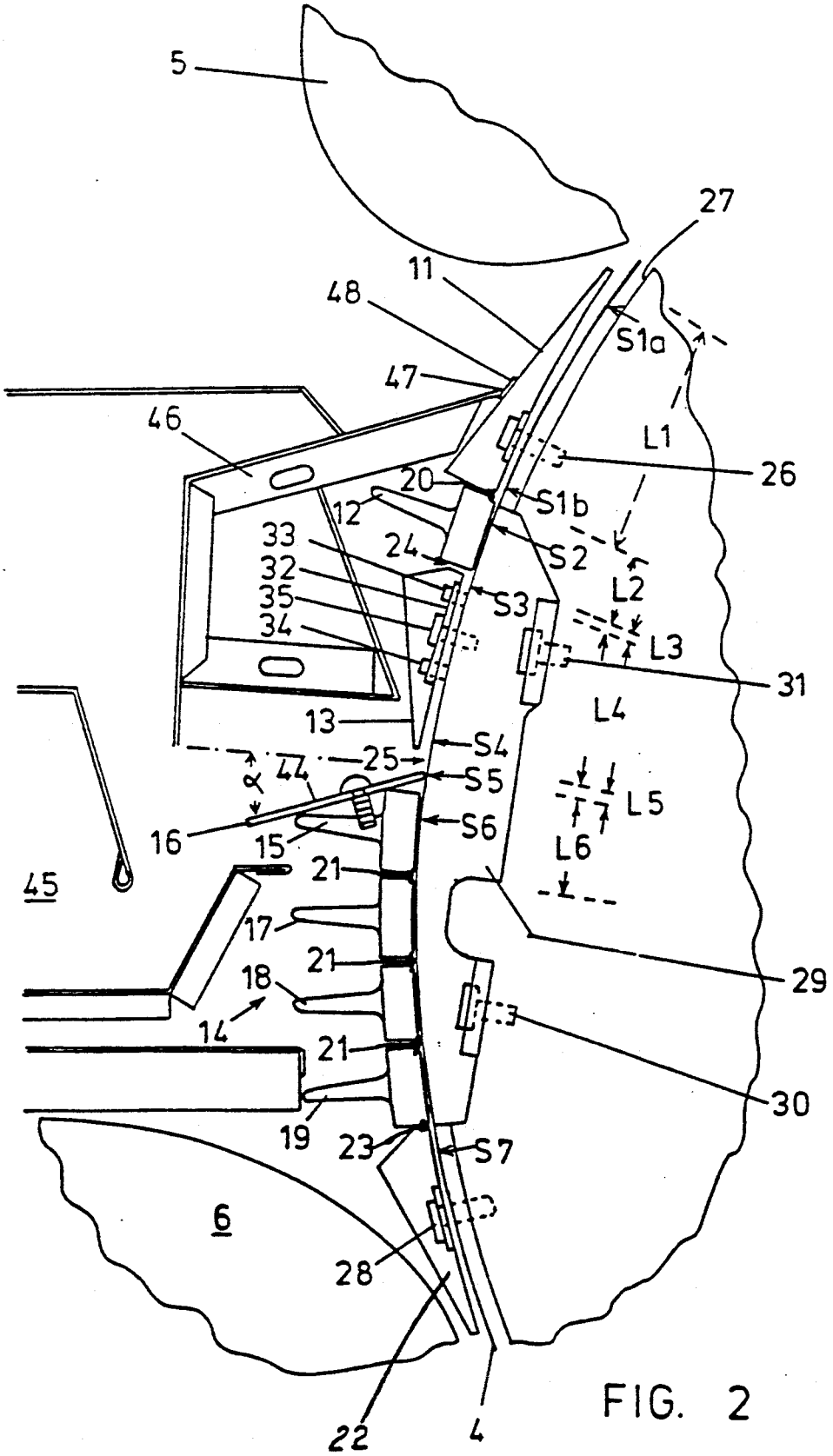
FIG. 2 is an enlarged schematic side elevation view of part of a first embodiment of carding engine according to the invention.
Figure 3:
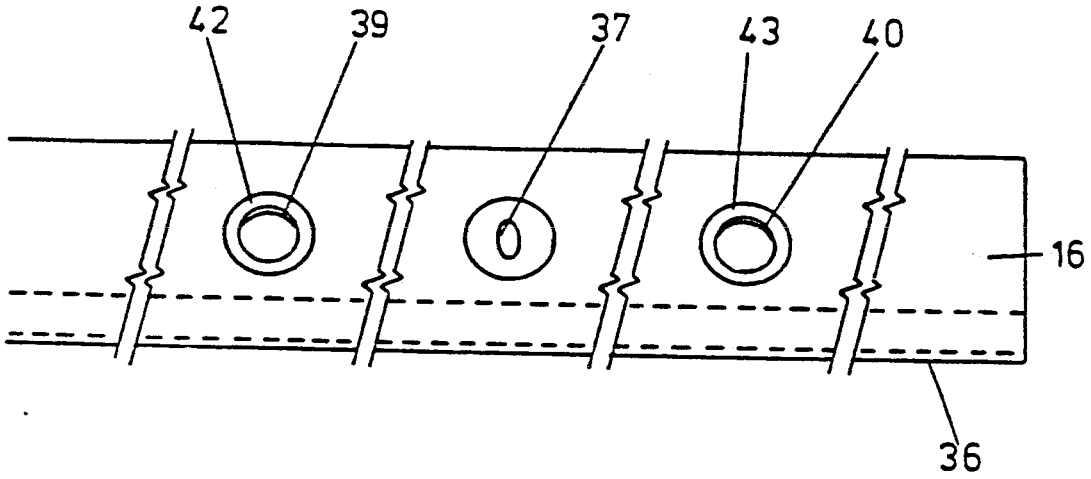
FIG. 3 is an elevation taken on the arrow III—III of FIG. 2.
Figure 4:
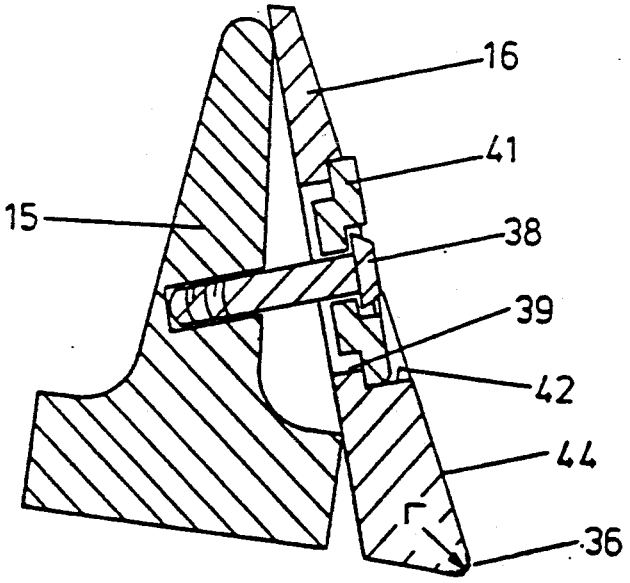
FIG. 4 is a further enlarged section on line IV—IV of FIG. 3.

Referring now to FIG. 2 the cover assembly comprises a first cover 11, a second cover 12 formed by a flat bar having carding elements and set radially closer to the surface of the cylinder 4 than the first cover 11, a third cover 13 having a smooth inner surface and set further from the cylinder surface than the second cover, and a fourth cover 14. The fourth cover is a composite cover having a first part formed by a flat bar 15 carrying a plate 16, and second, third and fourth parts 17, 18, 19 each again formed by a flat bar. The flat bars each carry carding elements facing towards the cylinder surface. A sealing member 20 is interposed between the first and second covers 11 and 12, and sealing members 21 are interposed between respective parts of the fourth cover 14. A bottom sheet 22 extends from the downstream end of the fourth cover, and a further sealing member 23 is interposed at the junction.

A first gap 24 is left between the second and third covers and a second gap 25 is left between the third and fourth covers. As is well known, the main cylinder 4 is supported for rotation between side structures which include bend arrangements provided support for the ends of the movable flats 5 and also providing support for other elements of the carding engine. In the embodiment of FIG. 2 the first cover 11 extends the full width of the cylinder and is secured by a bolt 26 at each end to part 27 of the bend arrangement at the respective side of the main cylinder. Shims may be provided between the first cover 11 and the bend arrangement to provide required radial setting S1*a* and S1*b* between the innermost part of the first cover and the outermost part of the tips of the teeth on the main cylinder 4, at the leading and trailing edges of the cover respectively. Similarly, the bottom sheet 22 extends the full width of the cylinder and is secured at each end by a both 28 to the bend arrangement, with the required radial setting S7 relative to the main cylinder surface being established by shims.

At each side of the main cylinder a support plate 29 is secured to appropriate parts of the bend arrangement by bolts 30, 31. The second cover 12, third cover 13 and all four parts of the fourth cover 14 extend over the full width of the main cylinder and are secured at their ends to the respective support plate. The flat bar forming the second cover 12, and each of the four flat bars 15, 17, 18, 19 of the fourth cover are each secured at their ends by bolts (not shown) to the respective support plate 29, with their required radial settings S2 and S6 relative to the main cylinder surface being established by shims. The third cover 13 has end sections 32 formed with a central hole and with two forward and two rearward tapped holes arranged in rectangular pattern about the central hole. Grub screws such as 33, 34 are engaged in the tapped holes and bear on the support plate 29, and a bolt 35 passes loosely through the central hole. The grub screws can be turned to establish required surface settings S3, S4 between the main cylinder and the front and rear parts respectively of the cover 13. The bolts 35 holds the cover in its required position of adjustment.

The plate 16 that is carried by the flat 15 has a leading edge 36 pointing into the direction of rotation of the main cylinder and separated from the main cylinder surface by radial setting S5. The plate is supported by the flat 15 at a central and two side locations. At the central location a bolt (not shown) passes through an elongate sot 37 in the plate to engage a tapped bore in the flat. At each side location a bolt such as 38 passes through a respective circular opening 39, 40 and through an eccentric cam such as 41 received in an oblate section 42, 43 of the plate. By releasing the three bolts the cams can be rotated to move the plate 16 relative to the flat 15 and to adjust the setting S5, the required setting being locked by tightening the bolts. The front face 44 of the plate 16 desirably makes an angle $\alpha$ of between 15° and 25° to a plane that is radial of the main cylinder and includes the leading edge 36. The leading edge is preferably formed with a rounded nose region which, when seen in cross-section approximate to an arc of a circle having a radius r that is from 0.5 to 0.6 mm, more preferably 0.125 to 0.3 mm.

As the movable flats 5 move away from the main cylinder to their return path, waste is stripped from the flats and falls as flat strips. These conventionally collect in a plenum 45 and are extracted therefrom by suction. The falling strips should not be allowed to obstruct the cover assembly, and this is conveniently prevented by supporting an additional plenum 46 adjustably mounted on the side structures of the carding engine and extending the full width of the carding engine to form shielding means covering the first gap 24. The plenum 46 has open ends so that a supply of clean air can be drawn into the plenum from the sides of the carding engine. The upper wall of the plenum 46 has a free edge 47 which desirably contacts a resilient sealing strip 48 secured to the outer surface of the first cover 11.

In use, the main cylinder 4 moves away from the flats 5 carrying on its surface the carded feed stock and retained waste. The close setting of the second cover 12 forms an air barrier at the junction between the covers 11 and 12, which air barrier has two effects. The first is to control air pressure in the region where the flats diverge from the cylinder to control the amount of flat strips taken by the flats, and the second is to create a pressure drop immediately downstream of the second cover 12, i.e. in the region of the first gap 24. This pressure drop is enhanced by the setting of the third cover 13 further away from the cylinder surface than the second cover 12, and the effect is to induce a rapid intake air flow through the first gap 24. This air flow penetrates the web carried on the cylinder surface and intermingles with the web in the region below the cover 13, serving to lift some of the remaining waste from the web. As that waste is heavier than the usable fibre it is thrown radially outwardly of the cylinder to be incorporated in the outer layer of the air flow. As the flow moves to the region of the gap 26 that outer part of the flow, with the waste entrained therein, is stripped away from the remaining flow by the leading edge of the plate 16 and diverted away from the cylinder surface. Thus, the air flow carries additional waste from the material, and that waste can be collected in the flat strip plenum 45 for extraction from the carding engine.

The various lengths of the cover elements and gaps, and the radial settings of the cover elements relative to the main carding cylinder are capable of substantial variation. For any given feed stock they may perhaps be best set empirically, but the following figures will give a guide to the lengths and settings that are presently thought to be usable. All setting are given as the radial distance between the innermost part of the cover and the outermost part of the tips of the teeth on the main carding cylinder.

| | | |
|---|---|---|
| First Cover 11 | Length L1 | 50–250 mm |
| Second Cover 12 | Length L2 | 20–45 mm |
| First gap 24 | Length L3 | 2–25 mm |

-continued

| | | |
|---|---|---|
| Third Cover 13 | Length L4 | at least 20 mm |
| Second Gap 25 | Length L5 | 2–25 mm |
| First Part 15 of Fourth Cover 14 | Length L6 | at least 20 mm |
| First Cover 11 | Leading Edge Setting S1a | 0.125–1.80 mm |
| | Trailing Edge Setting S1b (but less than setting S1a) | 0.5–1.0 mm |
| Second Cover 12 | Setting S2 | 0.125–0.25 mm |
| Third Cover 13 | Leading Edge setting S3 | 0.125 to 1 mm. |
| | Trailing edge setting S4 | 0.5 to 2 mm |
| First Part 15 of Fourth Cover 14 | Setting S5 | 0.125–0.75 mm |
| Parts 16 to 18 of Fourth Cover 14 | Setting S6 | approx. 0.125 mm |
| Bottom Sheet 22 | Setting S7 | 0.3–0.6 mm |

In order to illustrate the increase of efficiency obtained through use of this invention a carding engine fitted with a cover assembly as shown in FIG. 2 was operated using the same feed stock as the same carding engine used as a control and re-fitted with a cover assembly without the gaps 24 and 25. The settings of the various parts of the cover assembly were as follows:

| | |
|---|---|
| Setting S1a | 0.86 mm |
| Setting S1b | 0.74 mm |
| Setting S2 | 0.125 mm |
| Setting S3 | 0.56 mm |
| Setting S4 | 1.27 mm |
| Setting S5 | 0.178 mm |
| Setting S6 | 0.125 mm |
| Setting S7 | 0.48 mm |

The radius r of the nose region of leading edge 36 was 0.25 mm. The gap 24 was 8 mm in length and the gap 25 was 5 mm in length.

In the first set of tests the carding engine had a 102.2 cm diameter main cylinder running at 500 r.p.m. Double mote knives were fitted below the takerin. The feed stock used was a cotton containing a not excessive amount of trash, but with a high level of dust and of fibres less than 6.4 mm in length. Analysis of the feed stock and of the sliver formed by the carding operation showed that the control carding engine operated at a cleaning efficiency of 78.8 %, while the carding engine with the cover according to the invention operated at a cleaning efficiency of 84.85%. This is a very significant difference, and inspection of the slivers from the two carding engines showed that the visual appearance of the sliver from the carding engine according to the invention was marked superior to that of the sliver from the control.

In a second set of tests a more difficult feed stock was used, containing trash including a large number of small pieces of fragmented cotton feed stock having short, fuzzy fibres attached. In these tests the takerin was fitted with a single mote knife having an extension plate extending towards the feed plate. The control carding engine operated at a cleaning efficiency of 78.89%, with the carding engine of the invention having an efficiency of 81.06%. A third series of tests was run similar to the second set, except that the main carding cylinder of the carding engine used exhibited some cylinder wire damage. In this case, the cleaning efficiency was 71.69% for the control card and 81.99% for the carding engine of the invention.

It will be appreciated that the detailed construction of the cover assembly may be varied from that shown in FIG. 2.

We claim:

1. A carding engine comprising as feed roller, a toothed takerin, a toothed main carding cylinder and a toothed doffer, in which part of the circumference of at least one of the aforesaid toothed members is covered across substantially its full width by a cover assembly which, following the direction of rotation, comprises a first cover, a second cover set radially closer to the toothed member than the first cover, a third cover spaced circumferentially from the second cover by a first gap and set radially further from the toothed member than the second cover, a fourth cover spaced circumferentially from the third cover by a second gap and having a leading edge shaped to direct away from the toothed member part of the air stream flowing beneath the third cover during rotation of the toothed member.

2. A carding engine according to claim 1 in which the second cover is formed by at least one flat bar having carding elements confronting the teeth of the toothed member.

3. A carding engine according to claim 1 in which the third cover has a smooth inner surface confronting the teeth of the toothed member.

4. A carding engine according to claim 1 in which the leading edge of the fourth cover comprises a rounded nose region.

5. A carding engine according to claim 4 in which the nose region, seen in cross-section, has a profile that approximates to an arc of as circle having a radius of from 0.05 to 0.6 mm.

6. A carding engine according to claim 5 in which said radius is from 0.125 to 0.3 mm.

7. A carding engine according to claim 1 in which the third cover is set radially closer to the toothed member in the region adjacent to the first gap than in the region adjacent to the second gap.

8. A carding engine according to claim 1 in which the radial distance set between the third cover and the toothed member in the region adjacent to the first gap is at least three times the radial distance set between the second cover and the toothed member.

9. A carding engine according to claim 1 in which the toothed member on which the cover assembly is provided is the main carding cylinder, and the cover assembly covers and arc of that cylinder lying between carding elements which cooperate with the main carding cylinder to effect the carding action, and the doffer.

10. A carding engine according to claim 1 in which shielding means is provided over the first gap, shaped to ensure that air is drawn into the first gap only from the side of the carding engine.

* * * * *